United States Patent [19]

Ohashi et al.

[11] Patent Number: 4,971,637

[45] Date of Patent: Nov. 20, 1990

[54] RARE EARTH PERMANENT MAGNET

[75] Inventors: Ken Ohashi; Yoshio Tawara; Ryo Osugi, all of Fukui, Japan

[73] Assignee: Shin-Etsu Chemical Co., Ltd., Tokyo, Japan

[21] Appl. No.: 357,368

[22] Filed: May 25, 1989

[30] Foreign Application Priority Data

May 26, 1988 [JP] Japan ..... 63-129263

[51] Int. Cl.[5] ..... H01F 1/04

[52] U.S. Cl. ..... 148/301; 420/83

[58] Field of Search ..... 148/301; 420/83

[56] References Cited

U.S. PATENT DOCUMENTS 4,192,696 3/1980 Menth et al. ..... 148/301
4,279,668 7/1981 Kurz et al. ..... 148/301

FOREIGN PATENT DOCUMENTS 53-131222 11/1978 Japan ..... 148/301
57-104202 6/1982 Japan ..... 148/301
58-48650 3/1983 Japan ..... 148/301
59-28543 2/1984 Japan ..... 148/301
63-111602 5/1988 Japan ..... 420/83

*Primary Examiner*—John P. Sheehan
*Attorney, Agent, or Firm*—McAulay Fisher Nissen & Goldberg

[57] ABSTRACT

A rare earth permanent magnet of the formula $$R(Fe_{1-x-y}Co_xM_y)_z,$$

in which R is rare earth element(s) and/or Y, M is Si, Ti, Mo, B, W, V, Cr, Mn, Al, Nb, Ni, Sn, Ta, Zr, and/or Hf, and x, y, z are numbers such that $$0 \leqq x \leqq 0.99,$$

$$0.01 \leqq y \leqq 0.03, \text{ and}$$

$$8.5 < z < 12.0,$$

and in which the matrix cells consist of two finely segregated phases.

4 Claims, 4 Drawing Sheets

RARE EARTH PERMANENT MAGNET

BACKGROUND OF THE INVENTION

1. Field of the Invention

The present invention relates to a rare earth permanent magnet exhibiting excellent magnetic properties such as coercive force, and improved electric and electronic equipment in which the magnet is used.

2. Description of the Prior Art

Sm,Co-containing magnets are among the most commonly used high performance rare earth permanent magnets used in equipment, such as, loud speakers, motors, and various measuring instruments. However, samarium and cobalt are relatively expensive, and when used as raw materials in mass production, are the chief barrier to attaining economical production. To improve the economy of the process, as well as to upgrade the magnetic properties of the product magnets, the samarium content is reduced and the cobalt is replaced as much as possible by iron.

The conventional $SmCo_5$ type permanent magnets are based on a $SmCo_5$ compound having the hexagonal $CaCu_5$ structure (hereinbelow referred to as "the 1/5 structure" or "the 1/5 phase). Since these magnets are crystallographically balanced, it is impossible to reduce the Sm content and it is impossible to replace a part of cobalt with iron.

The conventional $Sm_2Co_{17}$ type permanent magnets are based on a $Sm_2Co_{17}$ compound having the rhombohedral $Th_2Zn_{17}$ structure (hereinbelow referred to as "the 2/17 structure" or "the phase 2/17 phase"). The Sm content of the $Sm_2Co_{17}$ type permanent magnet is about 8% lower than that of the $SmCo_5$ type permanent magnet. Also, while desired, no more than 20 at. % of the cobalt in the $Sm_2Co_{17}$ type permanent magnet can be replaced by iron without affecting the magnetic properties [T. Ojima et al, LEEE Trans Mag Mag-13, (1077) 1317]. In order to give rise to two phases in the $Sm_2Co_{17}$ type permanent magnet, inclusion of copper is essential. However, since Cu is a non-magnetic element, the amount of Cu should be as small as possible. For example, in a conventional magnetic compound of the formula $Sm(CoFeCuM)_z$ , the molar fraction of Cu based on the non-samarium elements can be reduced, at best, to 0.05. Further reduction leads to a precipitous decrease in intrinsic coercive force (iHc) [Tawara et al, Japanese Applied Magnetics Symposium 9, (1985) 20].

In the conventional $Sm_2Co_{17}$ type permanent magnets which are sintered in the manufacturing process, the molar ratio of Sm to non-samarium elements is often 1/7.5, i.e. $z=7.5$. However, in $Sm_2Co_{17}$ type permanent magnets, e.g., plastic magnets, which are directly heat-treated while in the ingot form rather than made by means of the powder sintering method and therefore not sintered, the usual molar ratio of Sm to non-samarium elements is from 1/8.0 to 1/8.2 [T. Shimoda, 4th International Workshop on Re-Co Permanent Magnets p.335 (1979)].

The binary-phase separation in the 2/17 magnets generally occurs such that the resulting phases are of $SmCo_5$ and $Sm_2Co_{17}$ compounds respectively, so that theoretically the molar ratio of Sm to non-samarium elements cannot be smaller than 1/8.5.

The above-referenced thesis of T. Shimoda discloses an example wherein the molar ratio of Sm to non-samarium was 1/8.94. However, since $Sm_2Co_{17}$ and Co coexist in the magnet of this example, the squareness of the magnetic hysteresis loop is substantially lost, i.e., the value given by $4Br^{-2}(BH)_{max}$ becomes far smaller than unity, wherein Br is the residual magnetization. Consequently the magnet of the example cannot be put to practical use.

Attempts to reduce the contents of Sm and Cu and to increase the Fe content in the samarium cobalt magnets have not been successful.

Nagel reported on a nucleation growth-type samarium magnet which contains no copper [H. Nage, 3M Confererence Proc. 29 (1976) 603]. However, this magnet has not been put to practical use because its coercive force undergoes wide changes with temperature.

The recently developed Nd-Fe-B magnets have higher magnetic properties than Sm-Co magnets, and are advantageous since they mainly comprise readily available. However, since neodymium has a high tendency to oxidize, it is necessary to hermetically coat the magnets containing Nd to prevent rusting. This necessity of coating, as well as the difficulty in finding appropriate coating materials suitable for mass production of Nd-Fe-B magnets, has thwarted economical mass production of the magnets.

The residual magnetization (Br) and the intrinsic coercive force (iHc) of the Nd-Fe-B magnets decreased sharply as the temperature rises, which is extremely inconvenient in practical use. Consequently, the operational temperature ranges of the Nd-Fe-B magnets are severely restricted especially due to the thermal instability of the intrinsic coercive force [D. Li, J. Appl. Phys 57(1985)4140]. The poor stability of the intrinsic coercive force is ascribable to the fact that the coercive force of the Nd-Fe-B magnets are given rise to by the nucleation growth of the crystal. As is the case with the Sm magnet of Nagel, it is, in principle, impossible to reduce the temperature coefficient of the intrinsic coercive force of the Nd-Fe-B magnets. The temperature coefficient of the intrinsic coercive force iHc of the Sm-Co magnets, whose coercive force results from the binary-phase structure, is less than that of the Nd magnets whose coercive force results from the nucleation growth of the crystal. Therefore, the Sm-Co magnets are more reliable in applications where high temperatures are encountered.

Previously we invented two kinds of rare earth magnets wherein the main phases are, respectively, of the $RFe_{12-x}M_x$ composition having the body-centered tetragonal lattice 1/12 structure ($ThMn_{12}$ structure) and of the $R(Fe_{1-x}Co_x)_{12-y}M_y$ composition (Japanese Patent Applications Nos. 62-224764 and 62-233481).

SUMMARY OF THE INVENTION

We have now discovered a new magnetic composition which increases the extent of the replacement of cobalt with iron, and which has its coercive force based on the binary-phase structure and is free of the above-mentioned shortcomings of the conventional magnets.

More specifically, we have discovered rare earth permanent magnets which have magnetic properties comparable with or better than the conventional Sm,Co-containing magnets, and which contain reduced amounts of expensive rare earth element(s) and can be dependably used at relatively high temperatures.

Specifically, the inventive magnets have chemical compositions represented by a formula $R(Fe_{1-x-y}Co_xM_y)_z$, wherein R represents at least one element selected from Y and rare earth elements, M represents at least one element selected from the group consisting of Si, Ti, Mo, B, W, V, Cr, Mn, Al, Nb, Ni, Sn, Ta, Zr, and Hf, and x, y, and z are numbers such that $0 \leqq x \leqq 0.99$, $0.01 \leqq y \leqq 0.30$, and $8.5 < z < 12.0$. The inventive magnets are also characterized in that the interiors of their matrix cells consist of two finely segregated phases.

The invention will be better understood in view of preferred embodiments thereof described with reference to the following figures.

DETAILED DESCRIPTION OF THE PREFERRED

Figure 1:
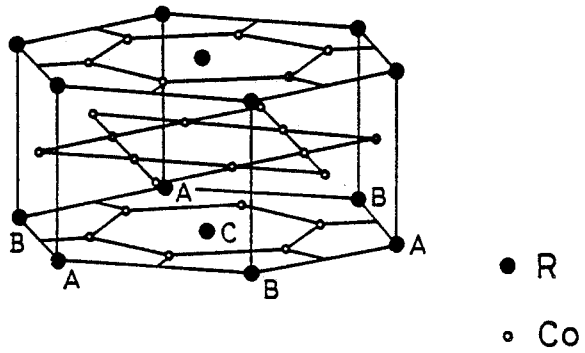
FIG. 1 shows the hexagonal crystal structure of a $RCo_5$ composition.
Figure 2:
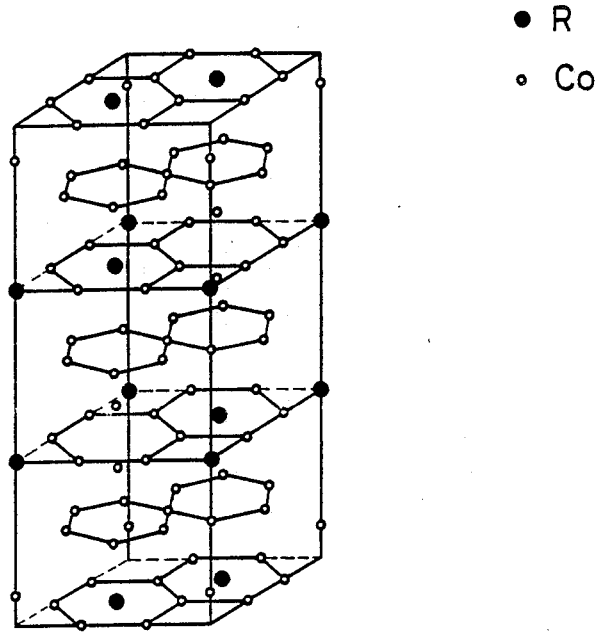
FIG. 2 shows the rhombohedral crystal structure of a $R_2Co_{17}$ composition.
Figure 3:
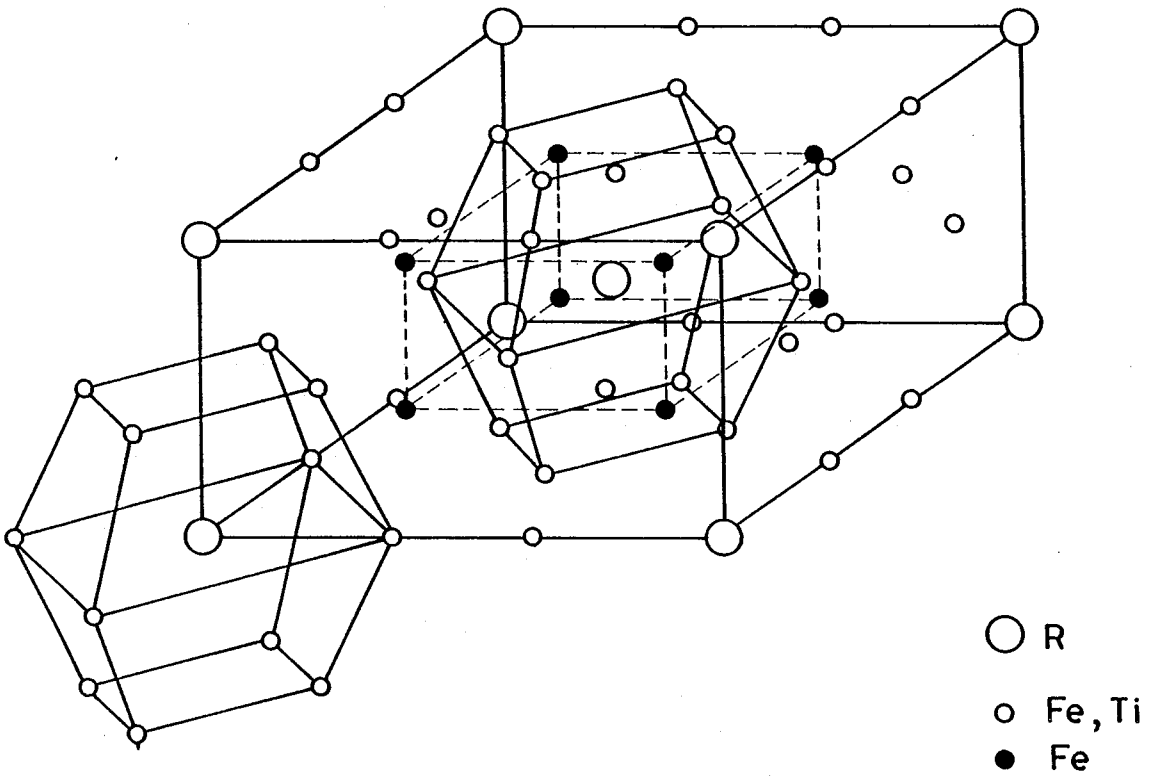
FIG. 3 shows the $ThMn_{12}$ type body-centered tetragonal structure of $RTiFe_{11}$ composition.

The inventors investigated the R-Fe-M and R-FeCo-M magnets disclosed in Japanese Patent Applications Nos. 62-224764 and 62-233481, and discovered that a composition having the $TbCu_7$ structure (1/7 structure) exists in these magnets at high temperatures. The crystal structures of 1/5, 2/17, and 1/12 type compositions are shown in FIGS. 1 through 3, respectively, and it is noted that the 1/5 structure is the basic structure, from which the 2/17 and 1/12 structures are derived. The crystal structure of 1/5, or $RCo_5$ type, consists of two different layers of atoms. One layer is composed of two kinds of atoms in the proportion of one rare-earth atom to two cobalt atoms with the rare-earth atoms arranged so as to form a triangular plane array with the cobalt atoms at the center of each triangle ABC. This layer alternates with another layer consisting of cobalt atoms only.

It is possible to formulate the derivations of the 2/17 and 1/12 structures from the 1/5 structure in the following equations:

$$3RM_5 - R + 2M = R_2M_{17}$$

$$2RM_5 - R + 2M = RM_{12}$$

wherein it is seen that $R_2M_{17}$ is obtained by replacing an R in $3RM_5$ with a pair of M's, and $RM_{12}$ is obtained by replacing an R in $2RM_5$ with a pair of M's. The 1/7 structure, unlike the 2/17, is obtained when a pair of M's replace R's and occupy the sites of R's in disorderly manners.

The 1/7 structure has been found in compositions such as $SmCo_7$, $Sm(CoCU)_7$, $Sm(CoFeCu)_{7.5}$, and $Sm(CoFeCuZr)_{7.5}$. This 1/7 structure provides the basis for the composing of Sm-containing, binary-phase type magnets. Because the 1/7 structure is unstable at room temperature, when an alloy having the 1/7 structure is heat-treated at an appropriate temperature and for an appropriate length of time, finely segregated 1/5 phase and 2/17 phase (both in sizes of from several hundred to three thousand angstroms) arise in the interiors of the matrix cells, and the resulting material exhibits a coercive force passable as a magnet. In the past, the 1/7 structure was only found in magnets whose compositions in terms of the z value in $R(CoFeCuM)_z$ were such that $5.0 \leqq z \leqq 8.5$, i.e., in those magnets in which the ratio of rare earth(s) to non-rare earth elements was between 1/5 and 2/17. The 1/7 structure was not known to exist in an alloy in which z exceeded 8.5.

The present inventors discovered that the 1/7 structure can exist in alloys whose z value is in the range of from 8.5 to 12.0, and that by subjecting an alloy based on these alloys to sintering and heat treatment, it is possible to produce a 2/17 phase ($Th_2Zn_{17}$ structure) and a 1/12 phase ($ThMn_{12}$ structure) in the alloy.

In the past, a Sm-containing, binary-phase magnet had to contain copper to produce phase segregation. However, in the present inventive magnets, the elements(s) M, which performs as the stabilizer of the 1/12 phase, also stabilizes the 1/7 phase.

Examples of the elements that can be used as R in the inventive alloy of formula $R(Fe_{1-x-y}Co_xM_y)_z$ are the rare earth elements, i.e., La, Ce, Pr, Nd, Sm, Eu, Gd, Tb, Dy, Ho, Er, Tm, Yb, Lu; and Y in addition. R can be any one of these elements or any combination of two or more of them. However, when R comprises one or more heavier rare earth elements, the saturation magnetization is not as high as when R is not one of these elements. Thus, lighter rare earth elements are preferred as the R element(s). Among the preferred rare earth elements, samarium is the most preferable and the saturation magnetization is improved if R is samarium alone or in combination with other light rare earth element(s).

When the value of z in formula $R(Fe_{1-x-y}Co_xM_y)_z$ is such that $z \leqq 8.5$ or $12.0 \leqq z$, the 1/7 structure will not stabilize at high temperatures. It is preferred that the value of z falls between 9.0 and 11.0.

Examples of the elements that can be used as M in the inventive alloy of formula $R(Fe_{1-x-y}Co_xM_y)_z$ are Si, Ti, Mo, W, B, V, Cr, Mn, Al, Nb, Ni, Sn, Ta, Zr, and Hf. M can be any one of these elements or any combination of two or more of them. The M elements(s) is employed for the purpose of stabilizing the 1/7 and 1/12 structures. However, if the content of M is such that $y \leqq 0.01$ or $0.30 \leqq y$, the 1/7 structure fails to stabilize, and the 1/12 structure fails to stabilize if $y \leqq 0.01$. Therefore, the content of M should be such that $0.01 \leqq y \leqq 0.30$.

In the present inventive magnetic alloy, it is possible to substitute Fe for the entire content of Co, unlike the conventional 2/17-structured binary-phase type magnets wherein the 1/7 structure is not stabilized when the Fe content is high. However, to obtain the highest possible saturation magnetization, the ratio of the Fe content to the Co content should be in the vicinity of 1:1. The thermal stability of the magnetic properties increase with increased Co content. The optimum ratio of the Fe content to the Co content, however, should be determined based on a consideration of economy of the composition as well as of the resulting magnetic properties and thermal stability.

The 1/7 phase, which is stable at high temperatures, underwent transformation into two finely segregated phases when subjected to a heat treatment of a temperature lower than 1,000° C. The inventors observed the organization in the host phase particles of the sintered magnet by means of a scanning electron microscope, and found no substance whose size was of the order of 1μm. The fact that the 1/7 phase transforms into the 2/17 and 1/12 phases has been confirmed by means of thermomagnetic curves and the powde X-ray diffraction diagrams.

The rare earth permanent magnet of the present invention can be obtained from the metals constituting the aforesaid composition in the following powder metallurgy procedure: melt the metals together, cast it, pulverize it into a fine powder, magnetically orient the powder in a mold in a magnetic field, press-mole the powder, sinter the compact, and treat it by heat. While the entire procedure of the powder metallurgy requires careful control, the sintering and heat treating steps should be conducted under the optimum conditions determined by the composition of the magnet. Care must be taken that the amounts of impurities such as oxygen and carbon, which inevitably get into the magnet during the manufacturing process will be minimized. When the oxygen content does not exceed 0.3% and the carbon content does not exceed 0.1%, their presence scarcely affects the magnetic properties of the resulting magnet. The rare earth magnet of the present invention is preferably made as an anisotropic sintered magnet. However, it is possible to obtain a high performance isotropic magnet of the invention by skipping the orienting step in the magnetic field.

The rare earth magnet of the present invention has a binary-phase structure, one phase being 2/17 and the other 1/12. It is thus different from the conventional 2/17-type Sm magnet wherein the 1/5 and 2/17 phases secretly coexist. Furthermore, in the magnet of the present invention, since the contents of Co and Fe can be completely replaced by one another, it is possible to arbitrarily select the ratio of Co to Fe. The content of rare earth element(s) in the inventive magnet can be smaller than that of the conventional 2/17-type Sm magnets without affecting the fact that the magnetic properties of the inventive magnet are as good as or even better than those of the conventional 2/17-type Sm magnets. Compared with the Nd magnets, the thermal stability of the coercive force of the inventive magnet is very high. Since temperatures of about 100° C. or higher hardly affect the properties of the inventive magnet, it can be used in wide range of applications. Although the Nd magnets need to have their surfaces coated or plated to avoid surface rusting making them unfit for use, the inventive magnet, like the conventional 2/17-type Sm magnets, is corrosion-resistant as it is so that no coating or plating is required in a normal application. It is however preferable to coat the inventive magnet with a material such as plastic resin and PVD, when it is used in a corrosive environment. It is also possible to make a plastic magnet by pulverizing the ingot of the invention which has received sintering or solution heat treatment.

The following examples illustrate the present invention.

EXAMPLE 1

Samarium, silicon, titanium, vanadium, chromium, aluminum, iron, and cobalt each having a purity of 99.9% were mixed in the various proportions by weight shown Table 1, and the mixtures are melted together in a high-frequency induction furnace. The melt was cast in a copper-made mold to prepare six ingots of different compositions indicated, respectively, as Nos. 1 through 5, and the Comparative Example, in the table. Each ingot was crushed and pulverized in a nitrogen jet mill into a fine powder having an average particle diameter of 2 to 5μm. The powder, in a mold, was magnetically oriented in a magnetic field of 15 kOe and shaped by press-molding in a hydraulic press under a pressure of 1.5 tons/cm$^2$ into a powder compact which was sintered for two hours in an atmosphere of argon gas at a temperature of 1000° to 1250° C. and subjected to an aging treatment for ten hours at 400° to 1000° C., followed by quenching.

Figure 4:
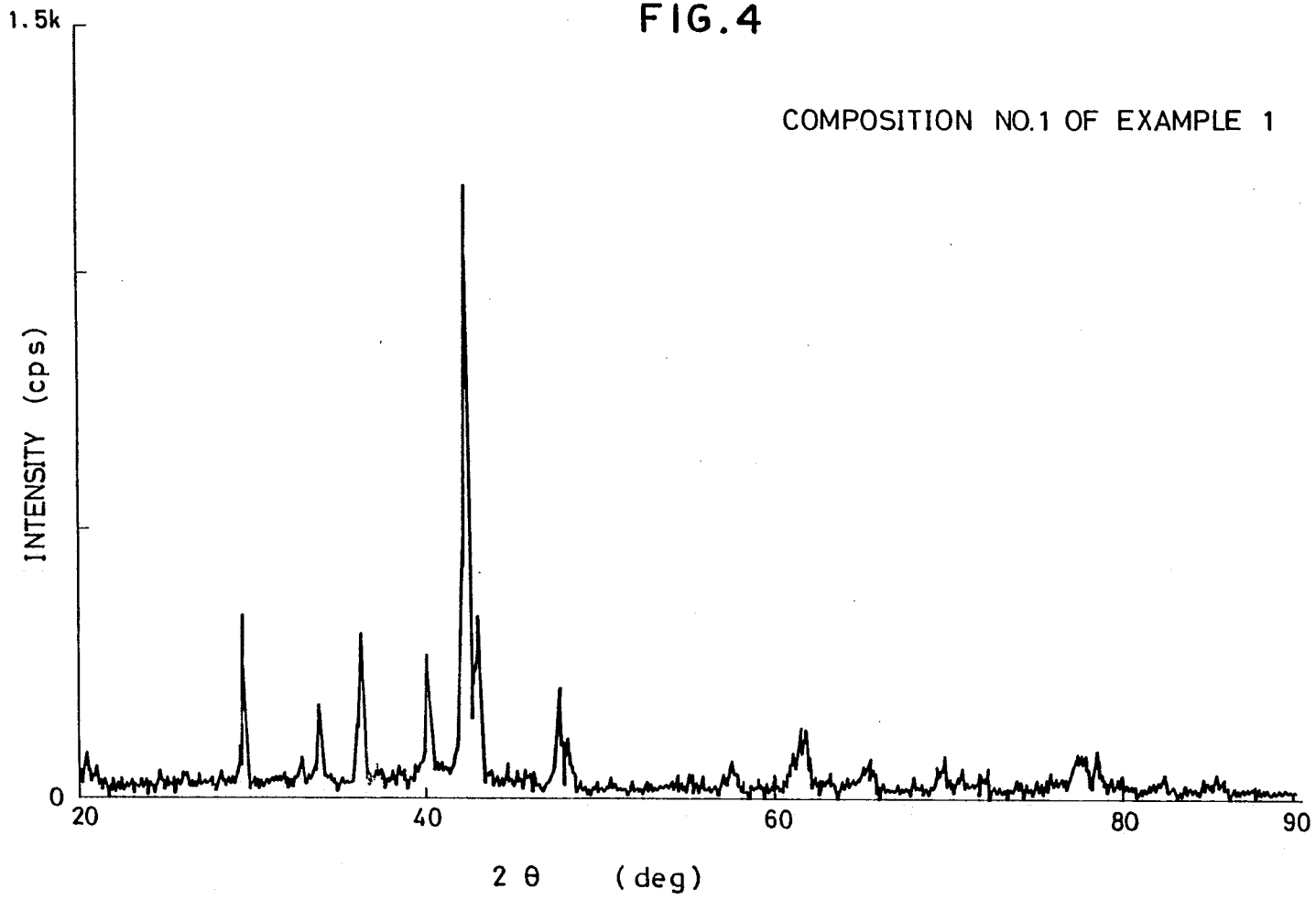
FIG. 4 is a chart showing a powder X-ray diffraction of Composition No. 1 of Example 1.
Figure 5:
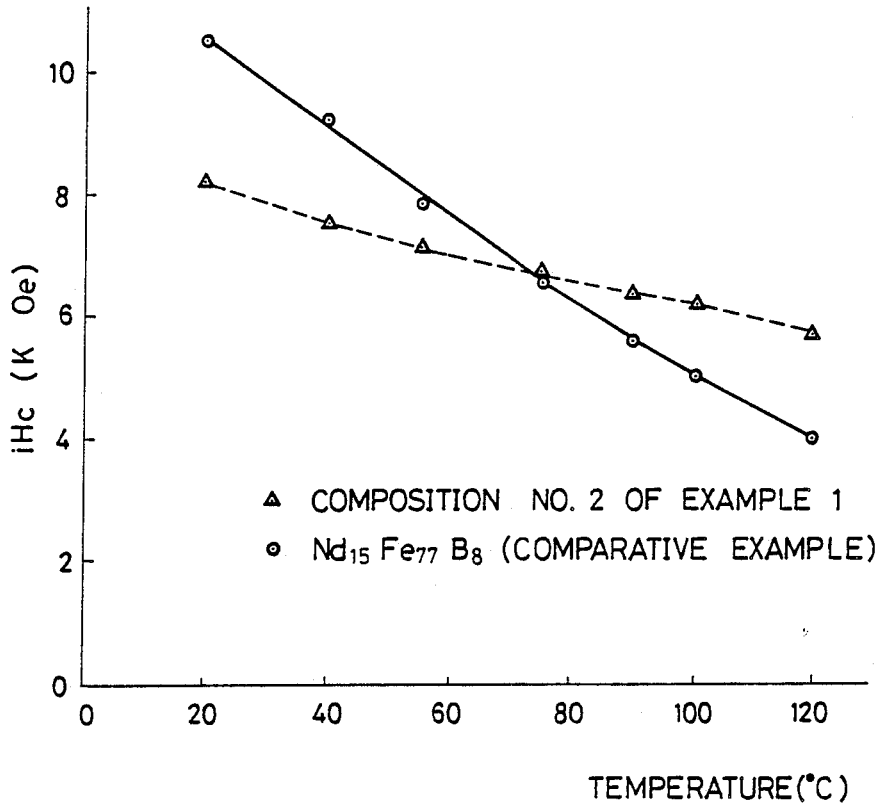
FIG. 5 is a chart showing the dependence of intrinsic coercive force on temperature in the cases of Composition No. 2 of Example 1 and the Comparative Example.

Table 1 also shows the intrinsic coercive forces iHc of the thus prepared anisotropic sintered magnetic substances. FIG. 4 shows a powder X-ray diffraction of Composition No. 1 of Example 1 taken after the sintering treatment (but before the aging treatment), which closely resembles the powder X-ray diffraction of 1/5 alloy. From the value of lattice constant c/a, Composition No. 1 was found to have the 1/7 structure. FIG. 5 shows the temperature dependence of the intrinsic coercive forces iHc of Composition No. 2 of Example 1 and a Nd magnet (Comparative Example) which has a composition of $Nd_{15}Fe_{77}B_8$ and was obtained by means of the conventional powder metallurgy procedure. As shown, the intrinsic coercive foirce iHc of Composition No. 2 of Example 1 is less affected by the temperature rise than that of the Nd magnet, and can be more reliably used at elevated temperatures.

TABLE 1

| | Composition: $Sm(Fe_{1-x-y}Co_xM_y)_z$ | | | | | |
|---|---|---|---|---|---|---|
| | Sample | | | | | Comparat. |
| Element | No. 1 | No. 2 | No. 3 | No. 4 | No. 5 | Example |
| Co | 0.2 | 0.4 | 0.6 | 0.8 | 0.0 | 0.0 |
| M | | | | | | |
| Si | 0.1 | — | — | — | 0.08 | — |
| Ti | — | 0.05 | — | 0.03 | — | — |
| V | — | — | 0.15 | — | — | — |
| Cr | — | — | — | 0.10 | — | — |
| Al | — | — | — | — | 0.10 | — |
| z value | 9.5 | 10.0 | 10.5 | 11.0 | 9.0 | 9.0 |
| iHc (kOe) | 9.0 | 8.2 | 11.5 | 10.2 | 9.5 | 0.1 |

EXAMPLE 2

Samarium, praseodymium, neodymium, dysprosium, iron, cobalt, silicon, and niobium each having a purity of 99.9% were mixed in five different weight proportions shown in Table 2 and five samples were prepared using the same procedure as described in Example 1. Table 2 also shows the coercive force of the respective samples.

The results in Table 2 also indicate the improved effects of the inventive magnets.

TABLE 2

| | Composition: $(Sm_{1-k-m-n}Pr_kNd_mDy_n)(Fe_{1-x-y}Co_xM_y)_z$ | | | | |
|---|---|---|---|---|---|
| | Sample | | | | |
| Element | No. 1 | No. 2 | No. 3 | No. 4 | No. 5 |
| Sm | 0.8 | 0.5 | 0.9 | 0.5 | 0.7 |
| Pr | 0.2 | — | — | 0.3 | — |
| Nd | — | 0.5 | — | 0.2 | 0.2 |
| Dy | — | — | 0.1 | — | 0.1 |
| Si | 0.1 | 0.08 | 0.07 | 0.05 | 0.1 |
| Nb | — | 0.03 | — | — | 0.1 |
| Co | 0.0 | 0.2 | 0.3 | 0.4 | 0.6 |
| z value | 9.5 | 9.5 | 10.0 | 10.0 | 10.0 |
| iHc (kOe) | 8.3 | 7.1 | 8.4 | 7.5 | 8.0 |

What is claimed is:

1. A rare earth permanent magnet comprising a chemical composition having the formula $R(Fe_{1-x-y}Co_xM_y)_z$, wherein R represents at least one element selected from the group consisting of Y and the rare earth elements, M represents at least one element selected from the group consisting of Si, Ti, Mo, B, W, V, Cr, Mn, Al, Nb, Ni, Sn, Ta, Zr, and Hf, and x, y, and z are numbers such that $$, 0 \leqq x \leqq 0.99,$$

$$0.01 \leqq y \leqq 0.30, \text{ and}$$

$$9.0 < z < 11.0,$$

said magnet having matrix cells consisting of two finely segregated phases of rhombohedral $Th_2Zn_{17}$ structure and body-centered tetragonal $ThMn_{12}$ structure.

2. The rare earth permanent magnet of claim 1 wherein R represents samarium plus at least one element selected from the group consisting of praseodymium, neodymium, and dysprosium.

3. The rare earth permanent magnet of claim 1 wherein R is samarium.

4. The rare earth permanent magnet of claim 1 wherein M represents at least one element selected from the group consisting of Si, Ti, Cr, Al, and V.

* * * * *